US007757465B2

(12) United States Patent
Budny et al.

(10) Patent No.: US 7,757,465 B2
(45) Date of Patent: Jul. 20, 2010

(54) APPARATUS AND METHOD FOR FILLING CONTAINERS WITH ROD-SHAPED PRODUCTS

(75) Inventors: Piotr Budny, Hamburg (DE); Thomas Müller, Hamburg (DE); Matthias Horn, Ahrensburg (DE); Michael Knabe, Geesthacht (DE); Arnd Meier, Beckdorf (DE)

(73) Assignee: Hauni Maschinenbau AG, Hamburg (DE)

( * ) Notice: Subject to any disclaimer, the term of this patent is extended or adjusted under 35 U.S.C. 154(b) by 69 days.

(21) Appl. No.: 12/068,637

(22) Filed: Feb. 8, 2008

(65) Prior Publication Data

US 2008/0190074 A1 Aug. 14, 2008

(30) Foreign Application Priority Data

Feb. 8, 2007 (DE) ..... 10 2007 007 068

(51) Int. Cl.
*B65B 19/00* (2006.01)

(52) U.S. Cl. ..... 53/473; 53/148; 53/151; 53/236; 53/444; 221/174

(58) Field of Classification Search ..... 53/473, 53/236, 444, 148, 151, 260, 234, 135.1; 221/174

See application file for complete search history.

(56) References Cited

U.S. PATENT DOCUMENTS 3,520,394 A * 7/1970 Seragnoli ..... 198/418.3
3,967,740 A 7/1976 Molins
4,181,212 A * 1/1980 Hinchcliffe ..... 414/416.05
4,183,192 A * 1/1980 Smaw ..... 53/444
4,365,703 A * 12/1982 Hinchcliffe et al. ..... 414/413
4,691,848 A * 9/1987 Gianese ..... 222/269
4,827,691 A * 5/1989 Hanada et al. ..... 53/151
5,179,817 A * 1/1993 Barnes et al. ..... 53/148

(Continued)

FOREIGN PATENT DOCUMENTS

DE 1 066 118 9/1959

(Continued)

OTHER PUBLICATIONS

German Office Action dated Sep. 12, 2007 issued in priority application DE 102007007068.5.

(Continued)

*Primary Examiner*—Thanh K Truong
(74) *Attorney, Agent, or Firm*—Venable LLP; Robert Kinberg; Leigh D. Thelen

(57) ABSTRACT

An apparatus is provided for filling an empty shaft tray with rod-shaped products. The shaft tray has shaft walls which form a plurality of shafts. The apparatus includes a filling hopper having a receiving region for a mass flow composed of the products, and a storage region for products comprising a front wall, a rear wall, side walls and a bottom wall. The storage region includes partitions that form a plurality of shafts adjacent to each other, wherein the partitions substantially extend over a full height of the storage region, and wherein the rear wall of the storage region includes openings for passage of the shaft walls of the shaft tray. A delivery element delivers the empty shaft tray into the receiving region of the filling hopper to be filled with the products. A removal element removes a filled shaft tray from the filling hopper.

17 Claims, 6 Drawing Sheets

U.S. PATENT DOCUMENTS

| | | | | |
|---|---|---|---|---|
| 5,190,428 | A * | 3/1993 | Bryant et al. | 414/403 |
| 7,171,796 | B2 * | 2/2007 | Spirito et al. | 53/444 |
| 2007/0000215 | A1 * | 1/2007 | Borderi et al. | 53/473 |

FOREIGN PATENT DOCUMENTS

| | | | |
|---|---|---|---|
| DE | 1 103 215 | | 3/1961 |
| DE | 1103213 | | 3/1961 |
| DE | 1 915 446 | | 5/1965 |
| DE | 37 08 791 | A1 | 9/1988 |
| DE | 42 26 165 | A1 | 2/1994 |

OTHER PUBLICATIONS

Expanded European Search Report issued in parallel dated Jun. 19, 2008, directed to EP Patent Application No. 08075103.5. 15 pages.

* cited by examiner

APPARATUS AND METHOD FOR FILLING CONTAINERS WITH ROD-SHAPED PRODUCTS

CROSS-REFERENCE TO RELATED APPLICATIONS

This application claims the priority of German Patent Application No. 10 2007 007 068.5, filed on Feb. 8, 2007, the subject matter of which is incorporated herein by reference.

BACKGROUND OF THE INVENTION

The invention concerns an apparatus for filling containers, in particular trays/shaft trays, with rod-shaped products, including a delivery element for delivering empty containers into the region of a filling hopper, each container having shaft walls for forming several shafts within the container, the filling hopper having a receiving region for a mass flow composed of the products, and a storage region for products composed of front wall, rear wall, side walls and a bottom wall, as well as a removal element for removing the filled containers.

Furthermore the invention concerns a method for filling containers, in particular trays/shaft trays, with rod-shaped products, including the steps of: delivering empty containers into the region of a filling hopper by means of a delivery element, each container having shaft walls for forming several shafts within the container, filling the containers with the products forming a mass flow by means of the filling hopper composed of receiving region and storage region, and removing the filled containers by means of a removal element.

Such apparatuses and methods are used in particular in the tobacco-processing industry. In particular in the manufacture of cigarettes or the like, the stockage, temporary storage, etc. of products or intermediate products such as e.g. cigarettes or filter rods may be desirable or necessary. The discharge and input of products into a production process is common. During discharge the products are collected in special containers, the so-called trays. These trays can have a common receiving chamber for the products. However, it has been shown that trays with individual shafts, so-called shaft trays, are frequently easier to handle and ensure storage which is gentle with the products.

From DE 37 08 791 A1 are known a method and an apparatus for filling containers with rod-shaped articles of the tobacco-processing industry. The device mentioned therein is however designed to fill a tray with a single receiving chamber. For this purpose the filling hopper has a storage region in which the products are also stored temporarily in a common receiving chamber. Only in a lower outlet region of the storage region are wall portions provided to form outlet shafts. For filling, the tray is brought from bottom to top into the region of the storage region, such that the tray more or less surrounds the storage region. After opening of shut-off means, the tray is lowered again so that the products pass into the common receiving chamber of the tray. This apparatus is however not suitable for filling the shaft trays described above. Furthermore, the stockage/temporary storage in the storage region of the filling hopper is untidy, which leads to a delay in filling the trays and places a load on the products.

To fill shaft trays, only apparatuses which have a storage region which is essentially composed of a filling funnel are known. Such an apparatus can be found e.g. in DE 1 066 118. This apparatus is suitable for sequential filling of individual shafts of a shaft tray by transporting the shaft tray cyclically under the filling funnel. This method of filling is time-consuming and needs high space requirements. A comparable apparatus can be found in DE 1 103 215.

SUMMARY OF THE INVENTION

It is therefore the object of the present invention to propose a compact and efficient apparatus for the automated filling of containers, in particular trays/shaft trays. It is a further object of the invention to propose a corresponding method.

This object is achieved by an apparatus of the kind mentioned hereinbefore by the fact that the storage region has partitions for forming several shafts adjacent to each other, the partitions essentially extending over the full height of the storage region, and that the rear wall of the storage region is designed with openings for passage of the shaft walls of the container. Due to this nested design or arrangement of containers, in particular shaft trays, on the one hand and storage region on the other hand, firstly a particularly compact apparatus is produced because there is provision for delivery of the empty containers from the rear, that is, in a horizontal direction. Secondly, the design according to the invention allows parallel filling of all shafts of a container, which improves the efficiency of the apparatus. Furthermore, it is ensured by the hopper shafts that the products are distributed gently and evenly to the individual shafts of the container.

Preferably adjacent partitions of two shafts of the storage region are spaced apart from each other to form a receiving chamber, the distance between adjacent partitions being slightly larger than the width of the shaft walls of the container. Due to the fact that the shaft walls can slide more or less completely into the receiving chamber, the products located inside the shafts of the storage region are stored particularly gently. To put it another way, the shaft walls of the container are not in contact at all with the products inside the shafts of the storage region during introduction of the shaft walls between the partitions of the storage device.

In an appropriate development of the invention, the number of adjacent shafts of the storage region corresponds to the number of shafts of the containers to be filled, which firstly further simplifies and accelerates the operation of parallel filling of all shafts of the container and secondly reduces the load on the products inside the storage region.

Advantageously, the partitions of the storage region are rounded on the side facing towards the receiving region. Rounded means all non-flat surfaces which cause products which pass from above out of the receiving region on to the partitions to be guided reliably to either one or the other side, so that congestion or the jamming of products is effectively prevented.

An appropriate development is distinguished by the fact that the receiving region of the filling hopper is designed as a mass flow reservoir. As a result, essential components of ordinary apparatuses can be used. The design of the filling station according to the invention is thus particularly well suited to being used as a conversion kit as well.

A preferred embodiment of the apparatus is further characterised by the fact that the receiving region of the filling hopper is designed as a throughflow conveyor, the throughflow conveyor having at least two openings for passage of the products into the storage region, and that the standby position of the empty shaft trays immediately in front of the filling hopper is offset vertically downwards. Due to the split distribution of the mass flow and the vertical offset of the standby position, in spite of the improved efficiency a low height of the apparatus and an input height which is unchanged in comparison with conventional apparatuses are achieved, so that adaptations of connecting elements are avoided.

The object is also achieved by a method with the steps mentioned hereinbefore by the fact that the operation of filling the containers is distinguished by the following steps: the empty containers are positioned in the region of a rear wall of the storage region of the filling hopper which has several shafts, conveying an empty container in a substantially horizontal direction into the optionally filled or yet to be filled storage region of the filling hopper, the shaft walls of the container passing through corresponding openings in the rear wall of the storage region, opening shut-off means in the region of each shaft of the storage region, and lowering the container for continuously and simultaneously filling all shafts of the container. The resulting advantages have already been mentioned above in connection with the apparatus, on account of which reference is made to the statements above to avoid repetition at this point.

Preferably the shafts of the storage region are refilled continuously with products from the receiving region, such that the shafts of the storage region are permanently filled. This ensures continuous and even filling of the shafts of the containers.

BRIEF DESCRIPTION OF THE DRAWINGS

Further advantageous or appropriate features, embodiments and steps of the method are apparent from the subsidiary claims and the description. Particularly preferred embodiments of the apparatus as well as the method are described in more detail with the aid of the attached drawings. The drawings show:

DETAILED DESCRIPTION

The shown apparatuses serve to fill containers with rod-shaped products, as well as to deliver and remove the containers. Various constructions can be used as the containers, e.g. trays, shaft trays as well as cases or the like.

Figure 1:
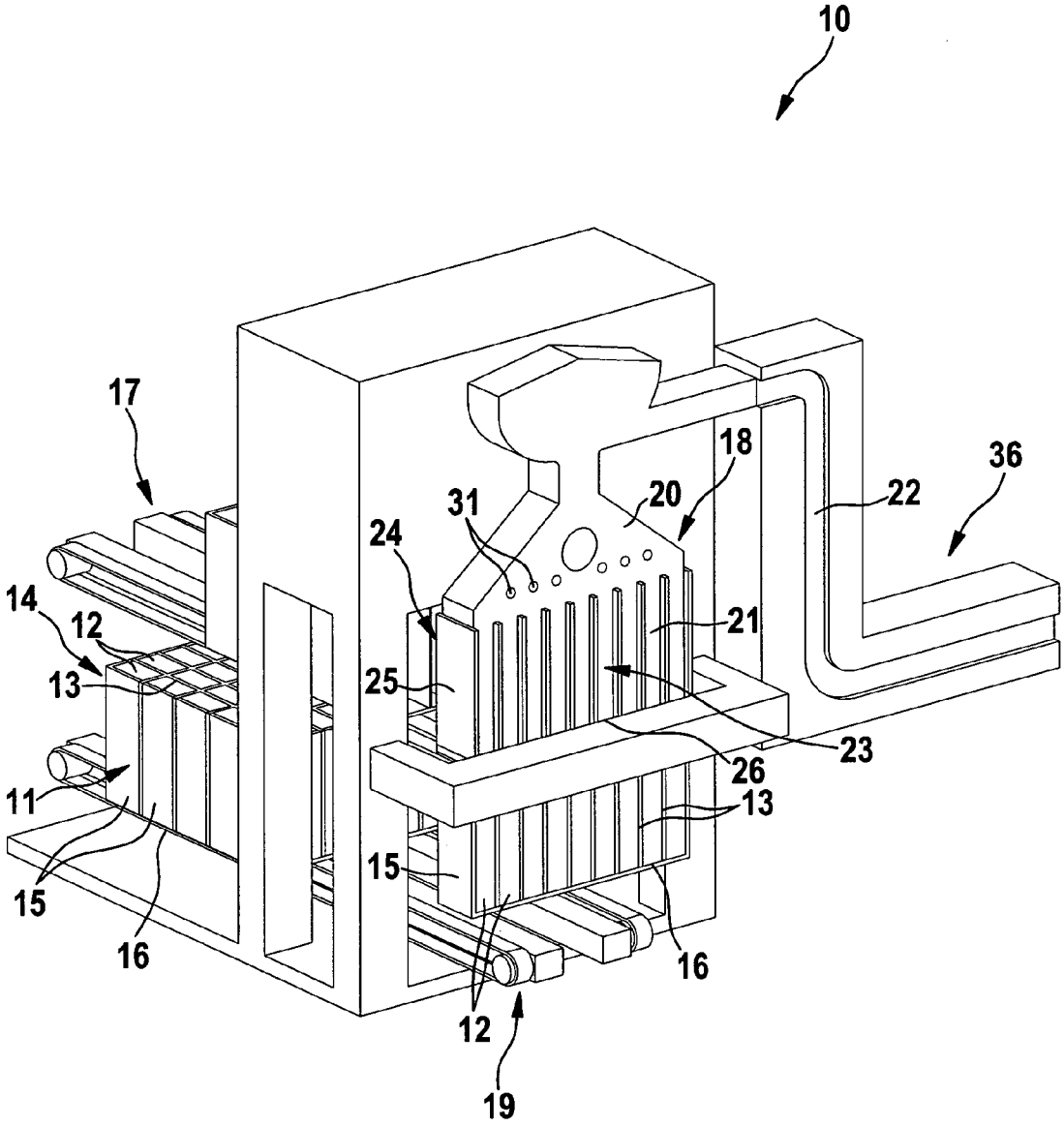
FIG. 1 a perspective view of an apparatus with a receiving region of the filling hopper designed as a mass flow reservoir, FIG. 2 a front view of the apparatus according to FIG. 1, FIG. 3 a perspective view of an apparatus with a receiving region of the filling hopper designed as a throughflow conveyor, obliquely from the top front, FIG. 4 an enlarged detail of section A according to FIG. 3, FIG. 5 a perspective view of the apparatus according to FIG. 3 obliquely from the top rear, FIG. 6 a front view of the apparatus according to FIG. 3, FIG. 7 an enlarged detail of section B according to FIG. 6, and FIG. 8 a side view of the apparatus according to FIG. 3.

The apparatus 10 according to FIG. 1 is designed for filling shaft trays 11 with cigarettes, filter rods or the like. As already mentioned, the apparatus is also constructed and designed for filling other containers. Below, the apparatus is described by way of example with reference to the shaft trays 11. The shaft trays 11 have several shafts 12 which are formed by shaft walls 13 inside the shaft tray 11. The shaft trays 11 are constructed in the usual manner, namely they have a closed rear wall 14, two side walls 15, the shaft walls 12 running parallel to the side walls 15 and a bottom wall 16.

The apparatus 10 essentially includes a delivery element 17 for delivering empty shaft trays 11 into the region of a filling hopper, the filling hopper 18 itself, and a removal element 19 for removing filled shaft trays 11. The delivery element 17 is designed as a belt conveyor or the like and runs substantially horizontally to the filling hopper 18. Preferably two parallel belt conveyors are provided, by means of which the empty shaft trays 11 can be conveyed transversely, that is, with shafts 12 arranged adjacent to each other, in the direction of the filling hopper 18. Below the delivery element 17 is arranged the removal element 19 which is designed similarly to the delivery element 17 and also has two parallel belt conveyors. Other conveying elements e.g. in the form of chain conveyors or the like can be used as well. Likewise the arrangement of delivery element 17 and removal element 19 can vary. By contrast with the delivery element 17 which runs horizontally in its direction of transport $T_z$, the removal element 19 is slightly inclined in its direction of transport $T_A$. To put it another way, the removal element 19 is slightly sloping in direction $T_A$, such that products located in the shaft tray 11 are supported against the rear wall 14.

Figure 7:
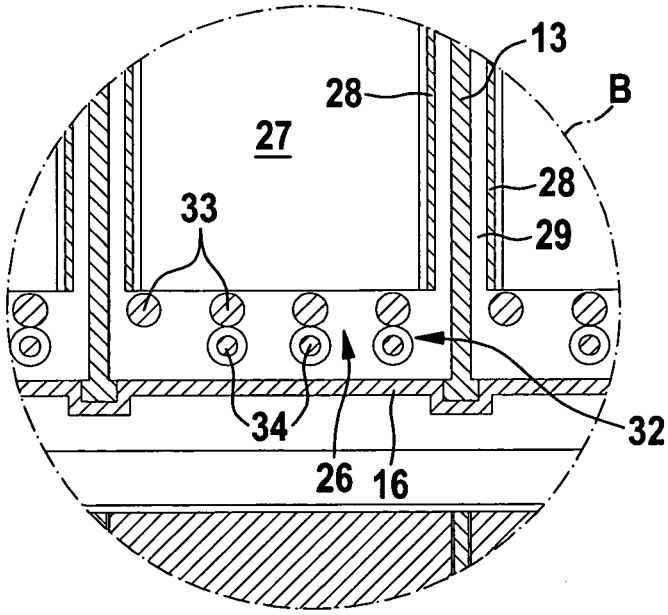
Figure 8:
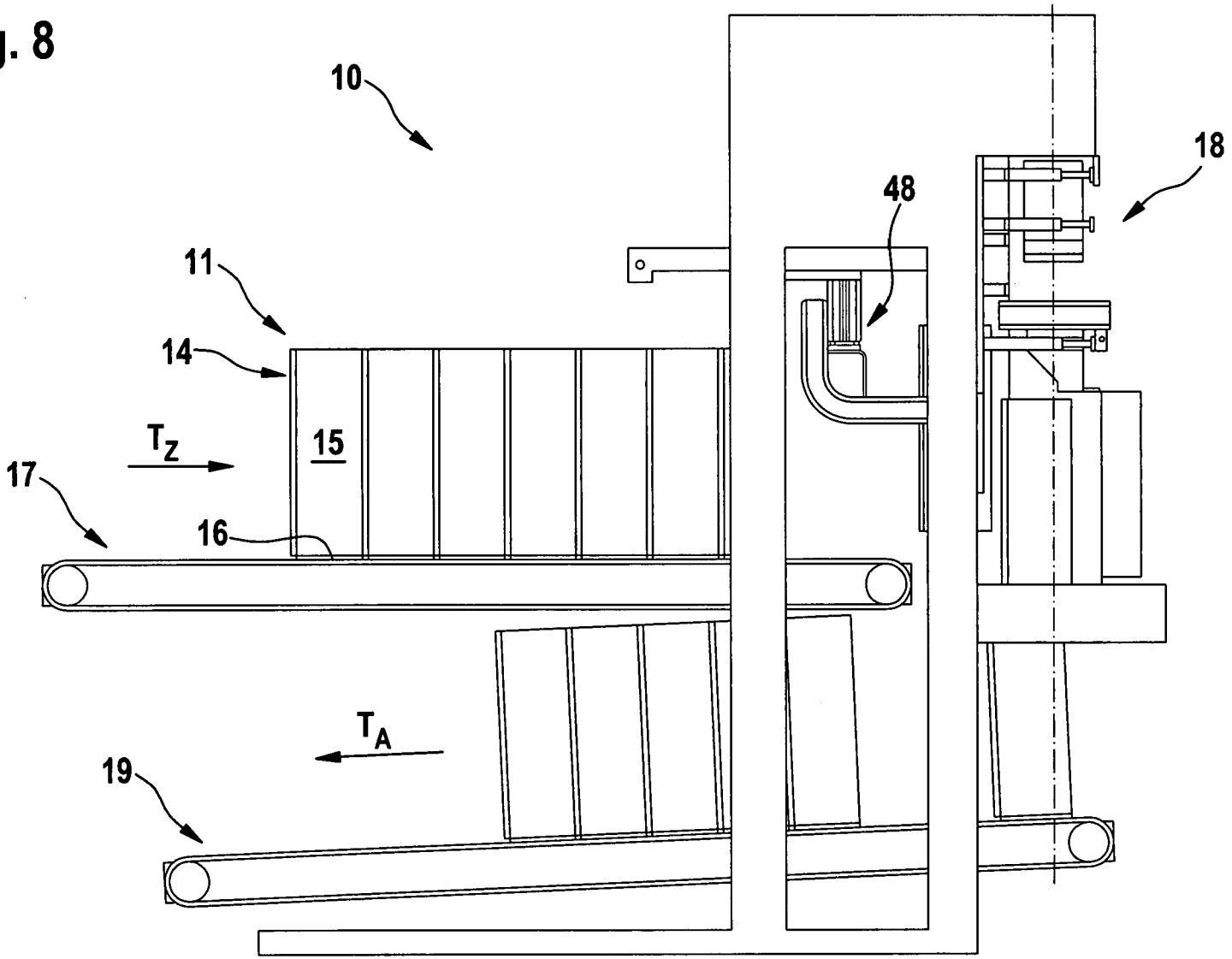

The filling hopper 18 has a receiving region 20 and a storage region 21. The receiving region 20 serves to receive a mass flow 22 consisting of the products. The structure of the receiving region 20 can vary, as described in detail below. The storage region 21 is composed of a front wall 23, a rear wall 24, side walls 25 and a bottom wall 26. The front wall 23 of the storage region 21 can also be the rear wall 24 and vice versa. The front wall 23 is preferably made transparent in the usual manner for purposes of better visibility and simplified access to the products and can be opened and closed. The storage region 21 has partitions 28 for forming several shafts 27. The partitions 28 run parallel to the side walls 25 and extend essentially over the full height of the storage region 21. Preferably the storage region 21 has exactly the same number of shafts 27 as a shaft tray 11 to be filled. The height of the shafts 27 in the storage region 21 corresponds approximately to the height of the shafts 12 of the shaft trays 11. The shafts 27 lie adjacent to each other and are each separated from each other by two partitions 28. Adjacent partitions 28 of two adjacent shafts 27 of the storage region 21 are spaced apart from each other so that between the adjacent partitions 28 is formed a gap or receiving chamber 29 (see in particular FIG. 7). The distance between two adjacent partitions 28 is slightly wider than the width of the shaft walls 13 of the shaft tray 11. To put it another way, the shaft walls 13 of the shaft tray 11 can extend completely into the receiving chamber 29.

To enable insertion of the shaft tray 11 in the filling hopper 18, the rear wall 24 of the storage region 21 is provided with openings 30 which allow the shaft walls 13 to pass through. These openings 30 are designed as vertically extending slots of which the width is slightly larger than the width of the shaft walls 13. The width of the slots in the rear wall 24 corresponds to the distance between adjacent partitions 28. In other words, the slots are designed or arranged in register with the receiving chambers 29, so that the slots allow direct and focused introduction of the shaft trays 11 or shaft walls 13 into the storage region 21.

Figure 6:
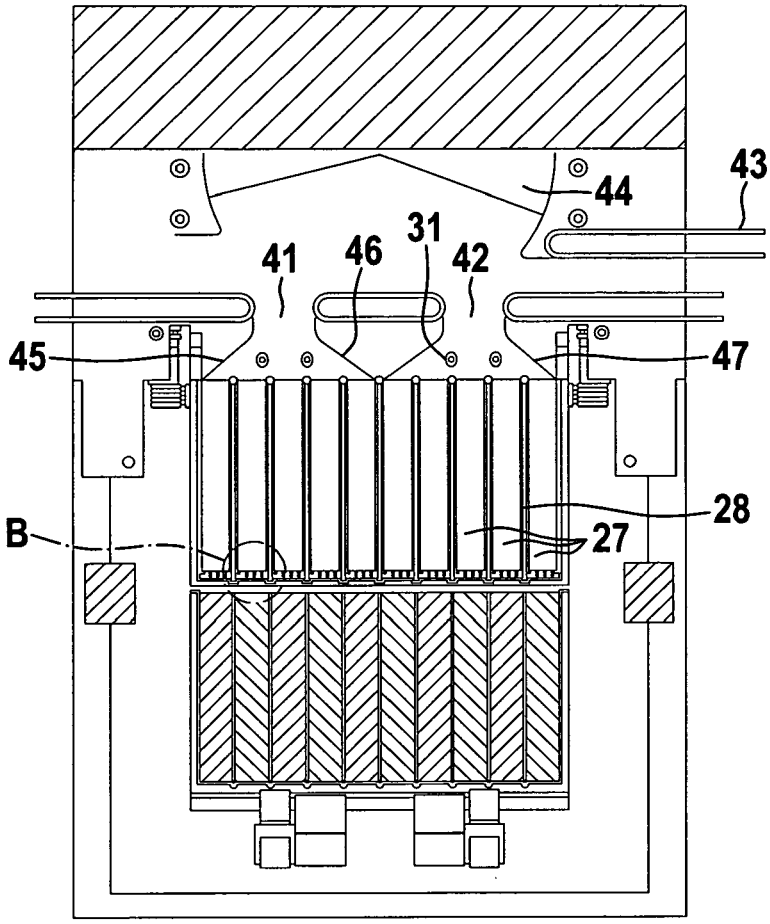

The shafts 27 of the storage region 21 are open at the top in the direction of the holding region 20, such that the products can flow freely into the individual shafts 27. For improved distribution and/or assistance of the mass flow 22 falling into the storage region 21, single or several guide elements 31 can be arranged between the receiving region 20 and the storage region 21 underneath. These guide elements 31 are usually arranged stationarily and optionally with fixed or rotating mounting. Optionally, the guide elements 31 which are for example elliptically shaped in plan view (e.g. according to FIG. 6) can also be driven. The number and position of the guide elements 31 can of course vary. As already mentioned above, the storage region 21 also has the bottom wall 26. The bottom wall 26 is designed as a shut-off means 32 in the embodiment described (see in particular FIG. 7). As a result, the shafts 27 of the storage region 21 are closable. This can also be achieved e.g. by a plate-like shut-off element, for example a slide rail or the like.

In the embodiment shown, each shaft 27 in its lower region facing away from the receiving region 20 is assigned its own shut-off means 32, the individual shut-off means 32 being controllable together or separately. A shut-off means 32 is composed of guide elements 33 and/or vibrator elements 34 which lie alternately adjacent to each other. The guide elements 33 can be fixed or e.g. driven in rotation to assist discharge of the products from the shafts 27 of the storage region. The vibrator elements 34 are further designed and arranged so as to be pivotable, such that they can be brought out of a closed position e.g. during a change of shaft tray, into an open position e.g. during filling of a shaft tray 11 or vice versa. The diameter of the vibrator elements 34 corresponds at least to the diameter of the products to be handled, but is preferably slightly larger. But other diameters are possible too.

The partitions 28 are uneven on the side facing towards the holding region 20. A simple embodiment provides that the edges of the partitions 28 are rounded. To be more precise, two adjacent partitions 28 are connected to each other by a semicircular cover 35 or the like, on the one hand to prevent products from falling into the receiving chamber 29, and on the other hand to prevent products from remaining on a horizontal surface and thus leading to a breakdown in product flow from the receiving region 20 to the storage region 21. Alternatively, in the region of the edges of the partitions 28 can also be arranged freely rotatable and/or driven rods, vibrator bolts or the like. The partitions 28 themselves can consist of such round and/or rotatable and/or driven rods, bolts or the like.

The delivery element 17 and the removal element 19 are, as described, arranged one above or below the other. By means of suitable lifting systems, this difference in height can be overcome. Such lifting systems, which are adequately well known and therefore not shown and described explicitly, are arranged in the region of the filling hopper 18. The lifting system serves to move the shaft trays 11 back and forth or up and down. In particular, the lifting system serves to lower the shaft trays 11 during the filling operation.

Figure 2:
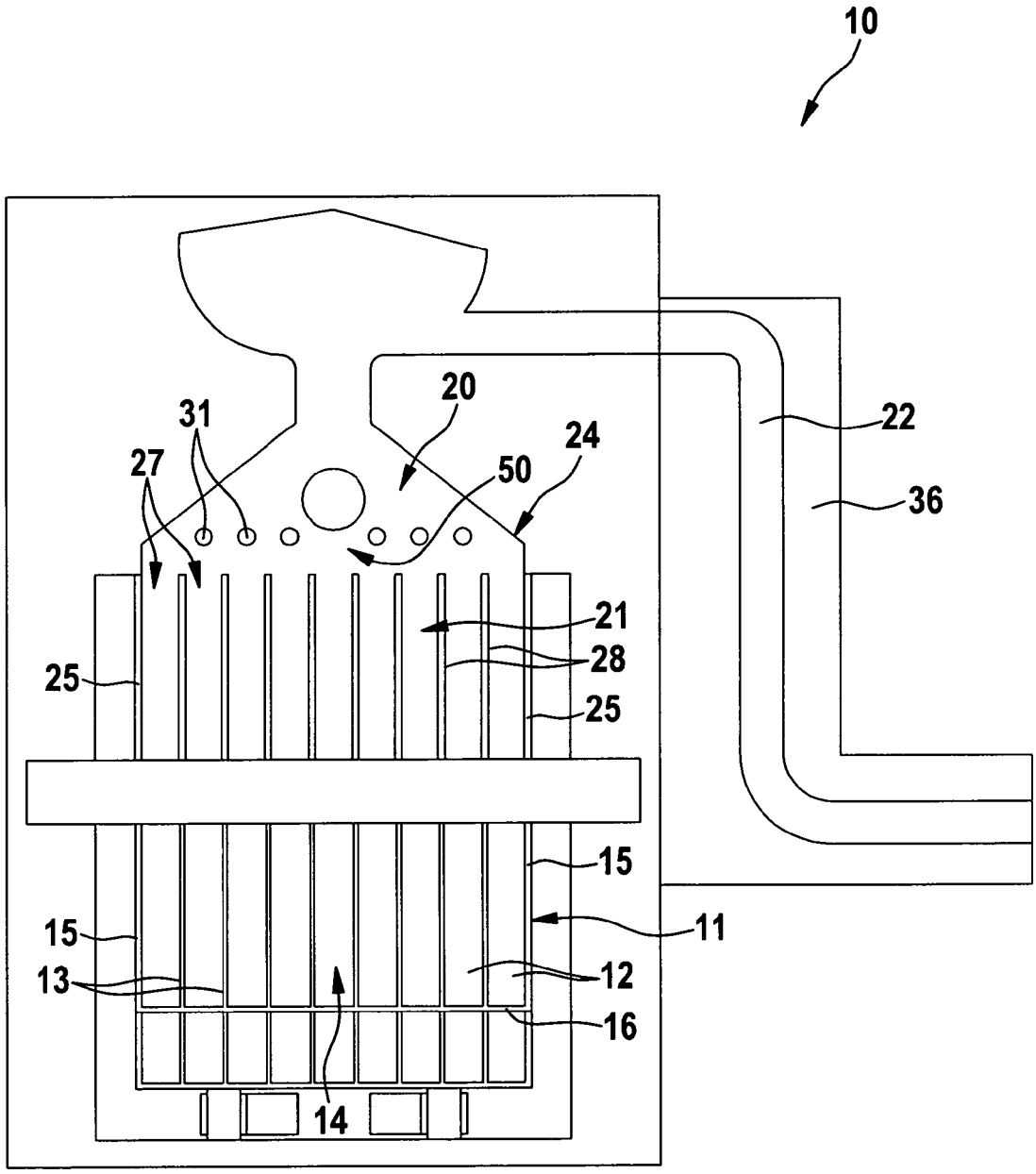
Figure 3:
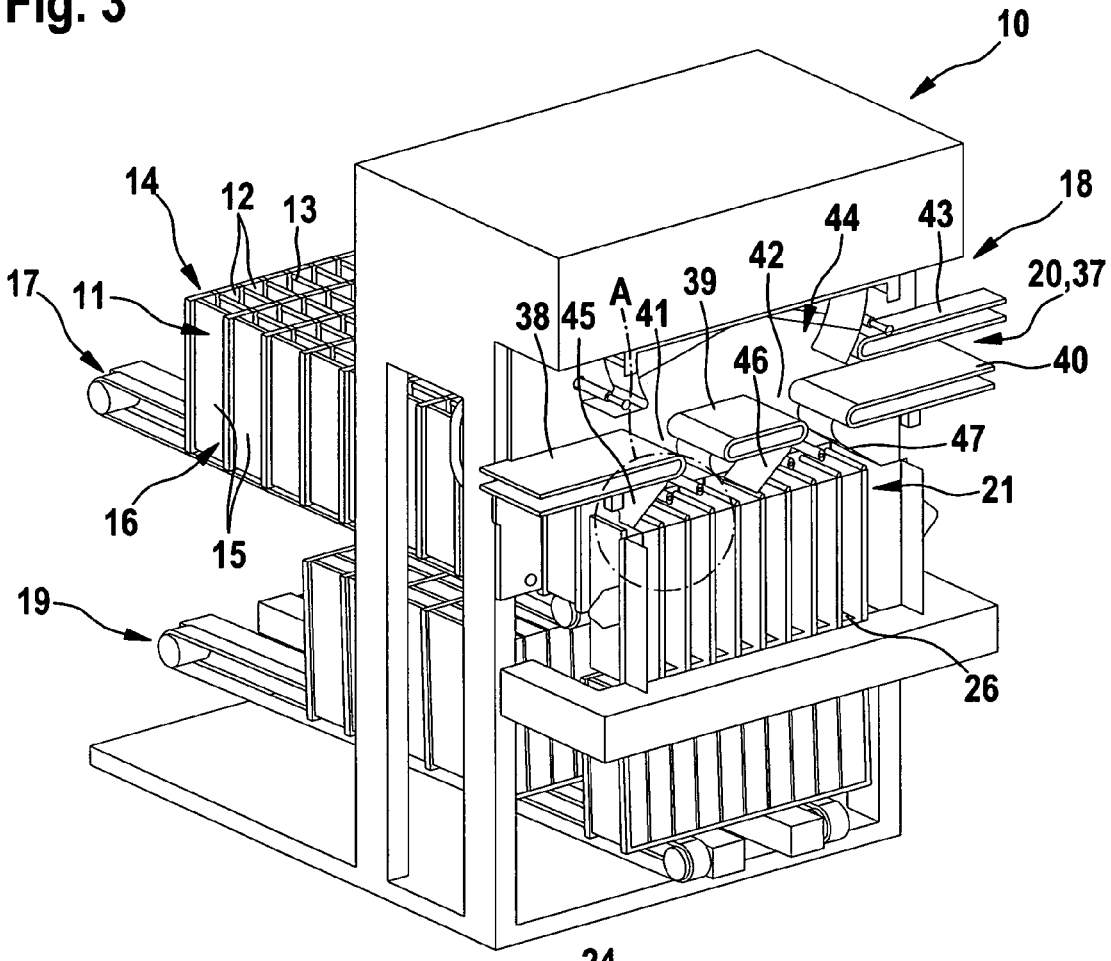
Figure 4:
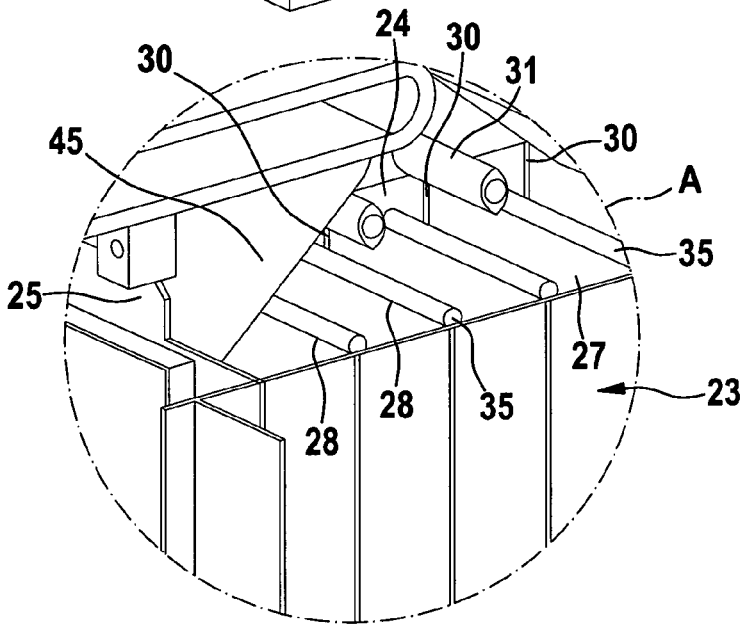
Figure 5:
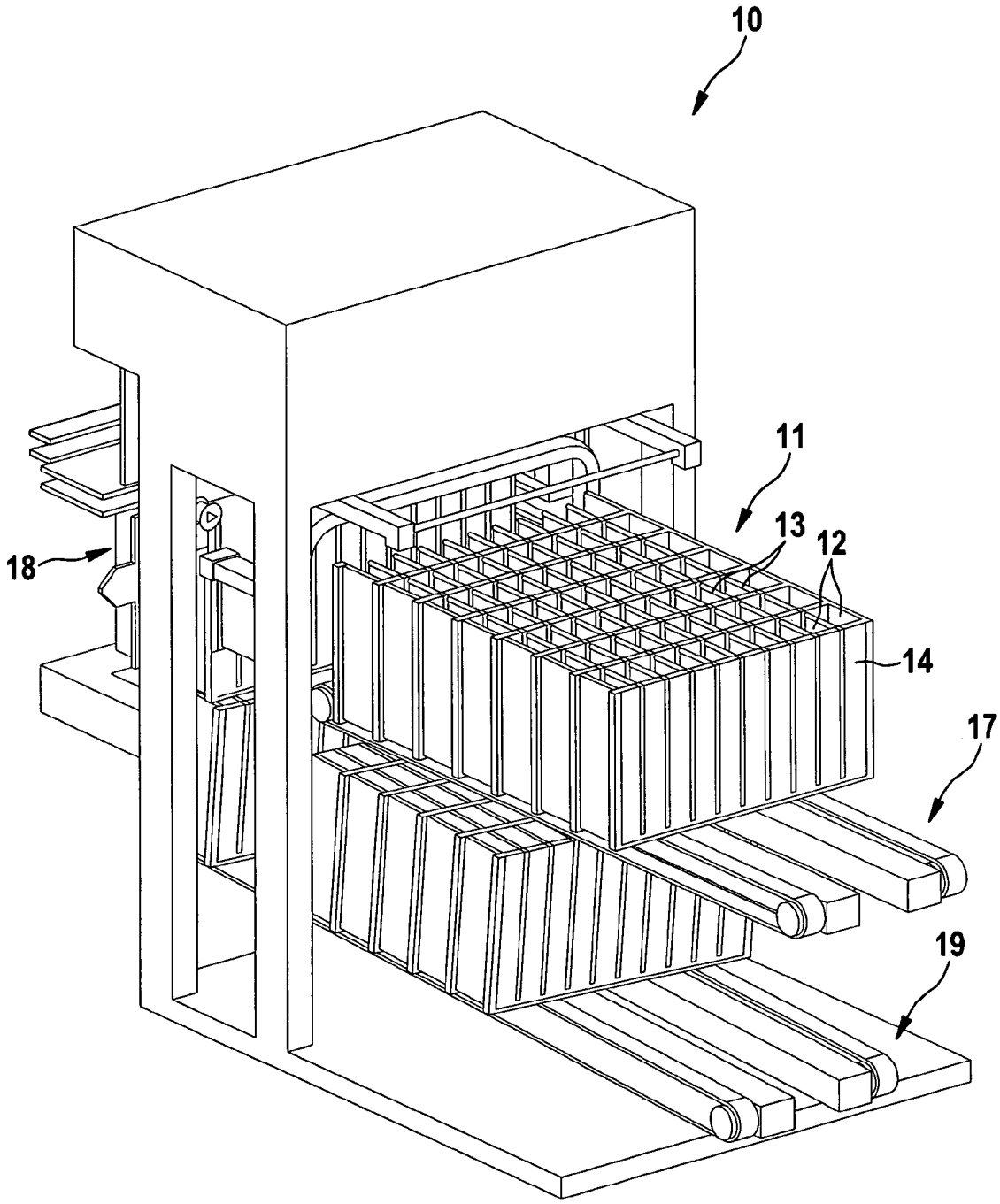

As indicated above, the receiving region 20 of the filling hopper 18 can be constructed variably. In the embodiment shown in FIGS. 1 and 2, the receiving region 20 is designed as a mass flow reservoir. This means that the mass flow 22 conveyed from known conveying systems 36 to the apparatus 10 flows via the receiving region 20, which widens in a funnel shape, directly into the storage region 21. The receiving region 20 is shaped and constructed in such a way that the funnel-shaped opening 50 covers all shafts 27 of the storage region 21, so that all shafts 27 can be filled simultaneously.

An alternative embodiment for the receiving region 20 can be found in FIGS. 3 to 8. Further details shown in FIGS. 3 to 8 basically also apply to the embodiment in FIGS. 1 and 2. In FIGS. 3 to 8 the apparatus 10 is equipped with a filling hopper 18 which has a throughflow conveyor 37 as the receiving region 20. The throughflow conveyor 37 runs substantially in a horizontal direction and is in several parts. Preferably, the throughflow conveyor 37 is composed of at least three conveying elements 38, 39, 40. The conveying elements 38 to 40 are arranged one behind the other and spaced apart from each other, so that between the individual conveying elements 38 and 39 or 39 and 40 are formed openings 41, 42 which serve for passage of the products from the receiving region 20 to the storage region 21. The conveying elements 38 to 40 all form a single conveying plane. Each conveying element 38 to 40 can be driven and controlled separately, the directions of conveying being reversible. Above the outer conveying elements 38 and 40 can optionally be arranged further conveying elements 43, as can be seen for example at the right edge of FIG. 3. Further, above the throughflow conveyor 37 can be provided a buffer hopper 44 of which the storage volume is variable. Beneath the conveying elements 38 to 40 are arranged baffle plates 45, 46, 47 or the like which also have a funnel-shaped construction widening in the direction of the storage region 21. This ensures that all shafts 27 of the storage region 21 can be filled simultaneously. Naturally the throughflow conveyor 37 can be formed by means of other elements (e.g. chains, etc.) and/or by a different arrangement of the elements with openings for passage of the products.

In the last-mentioned embodiment is also arranged a further lifting element 48 (see in particular FIG. 8) which is designed to convey the empty shaft trays 11 from the delivery element 17 vertically downwards into the region of the standby position immediately in front of the storage region 21. This lifting element 48 is preferably movable multiaxially.

Below, the principle of the method of the apparatus 10 is described in more detail with the aid of the figures. In the initial status, the apparatus 10 is free from products. In the region of the delivery element 17, empty shaft trays 11 stand ready, which are transported in the direction of the filling hopper 18 according to arrow Tz and in the case of the embodiment according to FIGS. 1 and 2 stand in their standby position immediately in front of the storage region 21 in the plane of conveying of the delivery element 17. In the case of the second embodiment in FIGS. 3 to 8 the empty shaft trays 11 are initially transported in the same way in the direction of the filling hopper 18 according to arrow $T_Z$. As the standby position in this embodiment is offset downwardly from the plane of conveying of the delivery element 17, each empty shaft tray 11 is lowered vertically downwards by means of the lifting element 48 or otherwise, in order there to adopt its standby position immediately in front of the storage region 21. In the standby positions described, the empty shaft trays 11 are positioned in the region of the rear wall 24.

During initial filling of the filling hopper 18, the mass flow 22 in the first embodiment is guided via the mass flow reservoir directly into the storage region 21. In the second embodiment the mass flow 22 is delivered to the storage region 21 via the throughflow conveyor 37, the products flowing through the openings 41, 42 into the storage region 21. During initial filling the bottom wall 26 is closed to the products. In other words, the shut-off means 32 are in their closed position. The great fall height of the products exists only during initial filling and is overcome by means of manual or automatic guided means, not shown, in a manner which is gentle to the product. Next the mass flow 22 is fed continuously, so that there is a continuous product stream. Optionally, before initial filling of the shafts 27 of the storage region 21 or after initial filling of the shafts 27, an empty shaft tray 11 is inserted horizontally in the storage region 21, the shaft walls 13 of the shaft tray 11 passing through the openings 30 or slots in the rear wall 24 and being placed in the receiving chambers 29 between the partitions 28. If the empty shaft tray 11 is in its filling position, the shut-off means 32 are opened so that the products can pass out of the shafts 27 of the storage region 21 into the shafts 12 of the shaft trays 11. For this purpose the shaft trays 11 are lowered in a known manner, so that simultaneous and continuous "refilling" of the products takes place from one shaft to the next. As soon as a given level in the shaft tray 11 is reached, the shut-off means 32 are moved back into their closed position. The now-filled shaft tray 11 can be transported by the removal element 19 out of the apparatus

10. As soon as the shaft tray 11 which has just been filled has completely left the storage region 21, an empty shaft tray 11 which has previously been moved into the corresponding standby position is introduced into the storage region 21 in the manner described.

The invention claimed is:

1. An apparatus for filling an empty shaft tray with rod-shaped products, the shaft tray having shaft walls extending from a bottom wall of the shaft tray which form a plurality of shafts, the apparatus comprising:

a filling hopper having a receiving region for a mass flow composed of the products, and a storage region for products comprising a front wall, a rear wall, side walls and a bottom wall, wherein the storage region includes partitions that form a plurality of filling shafts adjacent to each other, wherein the partitions substantially extend over a full height of the storage region, wherein adjacent partitions of two filling shafts of the storage region are spaced apart to form a receiving chamber to receive a respective one the shaft walls of the shaft tray, wherein the rear wall of the storage region includes openings for passage of the shaft walls of the shaft tray, and wherein the openings in the rear wall of the storage region are vertically extending slots having a width slightly larger than a width of the shaft walls;

a delivery element to deliver the empty shaft tray into the receiving region of the filling hopper to be filled with the products; and a removal element to remove a filled shaft tray from the filling hopper.

2. The apparatus according to claim 1, wherein a distance between adjacent partitions of two filling shafts is slightly larger than the width of the shaft walls of the shaft tray.

3. The apparatus according to claim 1, wherein the width of the slots in the rear wall corresponds to the distance between adjacent partitions of two filling shafts.

4. The apparatus according to claim 1, wherein the number of adjacent filling shafts of the storage region corresponds to the number of shafts of the empty shaft tray to be filled.

5. The apparatus according to claim 1, wherein the heights of the filling shafts of the storage region correspond to the heights of the shafts of the shaft tray.

6. The apparatus according to claim 1, wherein the filling shafts of the storage region have tops that are open in a direction of the receiving region and bottoms that are closable.

7. The apparatus according to claim 1, wherein each filling shaft of the storage region has a shut-off device in a lower region which constitutes the bottom wall.

8. The Apparatus according to claim 7, wherein the shut-off device comprises at least one of guide elements or vibrator elements.

9. The apparatus according to claim 8, wherein at least the vibrator elements are movable for opening and closing each filling shaft of the storage region.

10. The Apparatus according to claim 1, wherein the receiving region is arranged above the storage region and a plurality of guide elements are arranged between the receiving region and the storage region.

11. The Apparatus according to claim 10, wherein the partitions are rounded on a side facing towards the receiving region.

12. The Apparatus according to claim 1, wherein the delivery element is arranged above the removal element, the apparatus further comprising a lifting element for movement back and forth between the delivery element and the removal element.

13. The Apparatus according to claim 1, wherein the receiving region of the filling hopper comprises a mass flow reservoir.

14. The Apparatus according to claim 13, wherein the receiving region widens in a funnel shape in a direction of the storage region, so that all shafts of the storage region are fillable simultaneously.

15. The Apparatus according to claim 1, wherein the receiving region of the filling hopper comprises a throughflow conveyor, the throughflow conveyor having at least two openings for passage of the products into the storage region, and a standby position of the empty shaft tray immediately in front of the filling hopper is offset vertically downwards.

16. The Apparatus according to claim 15, further comprising a funnel shaped element associated with each opening in the throughflow conveyor, each opening in the throughflow conveyor widening in a direction of the storage region such that all filling shafts of the storage region are fillable simultaneously.

17. The Apparatus according to claim 15, wherein the throughflow conveyor comprises at least three separate conveying elements.

* * * * *